US006866222B2

(12) United States Patent
Varela

(10) Patent No.: US 6,866,222 B2
(45) Date of Patent: Mar. 15, 2005

(54) SPOOL FOR A ROLL DISPENSER

(76) Inventor: Fernando Varela, Avenida 18 de Julio 1026 of 1401, Montevideo (UY)

( * ) Notice: Subject to any disclaimer, the term of this patent is extended or adjusted under 35 U.S.C. 154(b) by 0 days.

(21) Appl. No.: 10/316,398

(22) Filed: Dec. 11, 2002

(65) Prior Publication Data

US 2003/0122029 A1 Jul. 3, 2003

(30) Foreign Application Priority Data

Dec. 11, 2001 (UY) ..... U 3874
Dec. 11, 2001 (UY) ..... U 3875

(51) Int. Cl.[7] ..... B65H 75/24; B65H 75/18

(52) U.S. Cl. ..... 242/571.4; 242/597.6; 242/613.2; 242/160.1

(58) Field of Search ..... 242/571.4, 571.5, 242/530.3, 545, 545.1, 597.5, 597.6, 613.2, 611.2, 160.1, 160.4

(56) References Cited

U.S. PATENT DOCUMENTS

| | | | | | |
|---|---|---|---|---|---|
| 1,168,188 | A | * | 1/1916 | Gammeter | 242/611.2 |
| 2,055,899 | A | * | 9/1936 | Hurt | 242/613.2 |
| 3,093,332 | A | * | 6/1963 | Jackson | 242/571.4 |
| 3,132,817 | A | * | 5/1964 | Atwood et al. | 242/611.2 |
| 3,285,528 | A | * | 11/1966 | Beindorf | 242/571.5 |
| 3,368,767 | A | * | 2/1968 | Schmidt | 242/611.2 |
| 4,625,931 | A | * | 12/1986 | Tamura et al. | 242/597.5 |
| 5,947,409 | A | * | 9/1999 | Corrigan | 242/571.4 |

FOREIGN PATENT DOCUMENTS

| | | | | |
|---|---|---|---|---|
| DE | 4226105 | * | 2/1994 | 242/571.4 |

* cited by examiner

*Primary Examiner*—John M. Jillions
(74) *Attorney, Agent, or Firm*—Pendorf & Cutliff

(57) ABSTRACT

A spool for a roll dispenser having a hub, an empty sapce between the hub and the roll, and a flat plate attached to one of the sides of the hub. The roll has a triangular or rectangular core.

2 Claims, 8 Drawing Sheets

SPOOL FOR A ROLL DISPENSER

BACKGROUND OF THE INVENTION

1. Field of the Invention

The present invention refers to a new shape of a spool for a roll dispenser.

2. Description of Related Art

The present invention concerns a spool for a roll dispenser, which due to the form of its parts and inherent characteristics, allows safe handling in the operation it will be used for.

Modern industrial societies are always confronted to changes in the way they consume products. They are very demanding in the packing of the products. Thus, in the process of development, the ways in which the different companies do their packing have changed, as well as the way they close the packages or boxes of diverse goods.

One of the devices that man uses for closing packages is an adhesive tape.

At the present, an adhesive tape roll displays a circular central section, which is put on a spool or a hub of the correct size for the central section of the roll. At the same time, it displays a calibrated clutch so that the adhesive tape stretching out from the roll gets the right tension and measure according to the characteristics of the machine.

Nevertheless, in practice, the circular central section usually slides. This may happen because the central section is too big or the structure of the spool is worn out, thus causing a loss of tension, which means uneven working in the automatic devices.

Usually, this difficulty is due to the fact that whenever the roll slides around its spool; this one does not regulate the tension of the tape any more as should be done by the calibrated clutch of the spools.

In accordance with the research work done on this, the technical and bibliographical antecedents which are available to date, and in view of those negative elements in use, i.e. taped rolls and spools or hubs of a regular round shape, the decision was taken by the aforementioned applicant, to study the way to improve the technique and the structure needed in order to avoid the uneven performance of the automatic packing devices using round spool or hub.

That is why the present inventor developed a new structure for the central section for rolls and the corresponding design of the spool or hub that aims to making the procedure easier and without restrictions as to its functioning.

BRIEF DESCRIPTION OF THE SEVERAL VIEWS OF THE DRAWINGS

This new structure can be seen in the following drawings attached herewith, i.e..

Figure 1A:
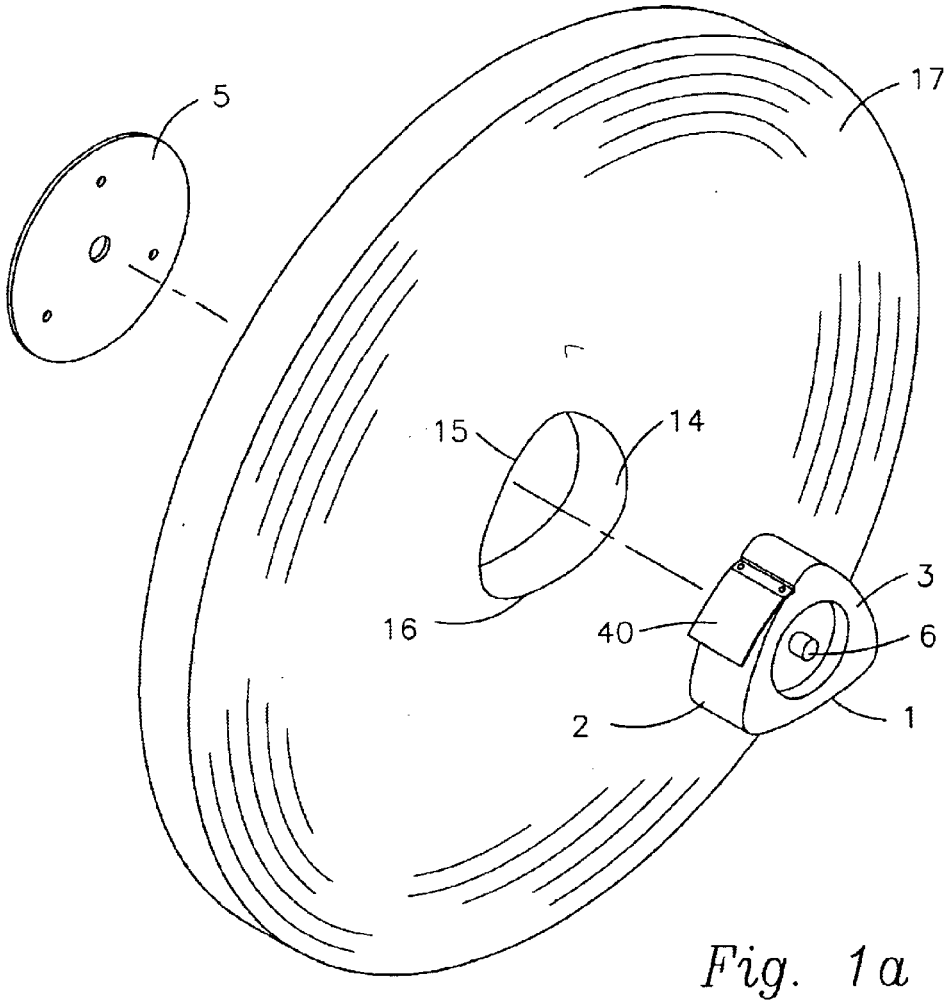
FIG. 1*a* shows an exploded perspective view of the spool for a roll dispenser according to the first embodiment of the present invention.
Figure 1B:
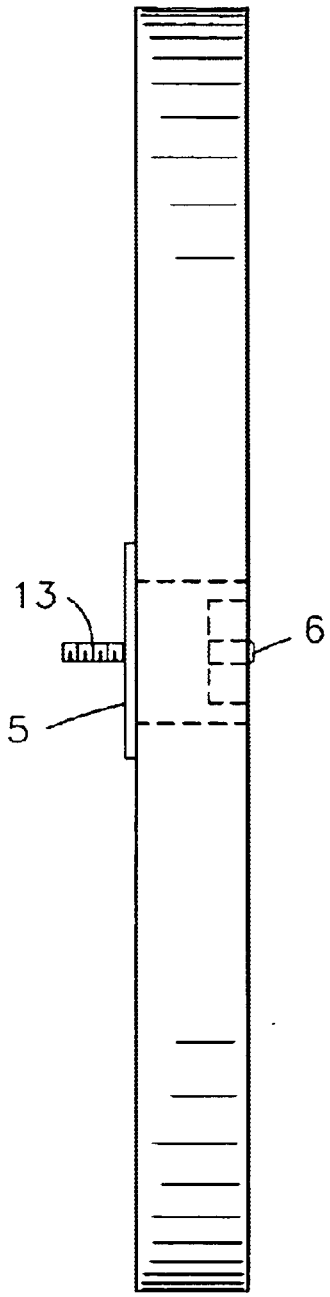
FIG. 1*b* is a side view of FIG. 1*a*.
Figure 1C:
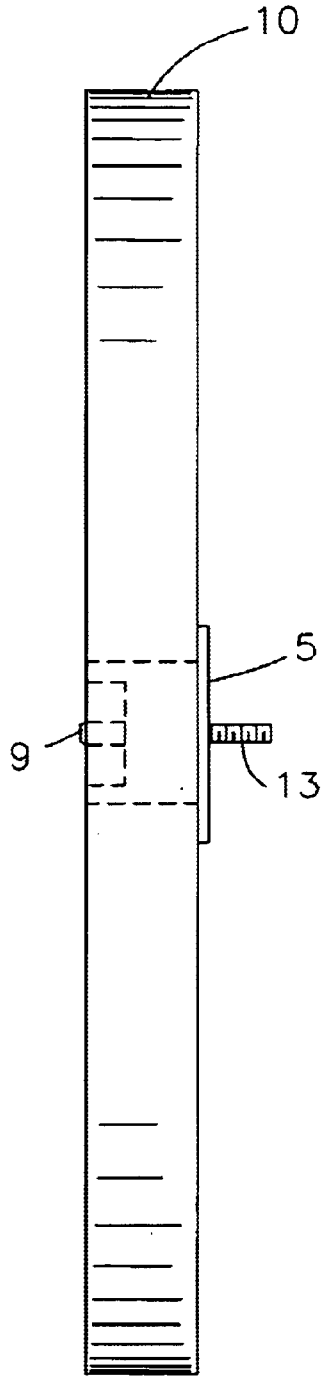
FIG. 1*c* is a side view of FIG. 1*d*.
Figure 1D:
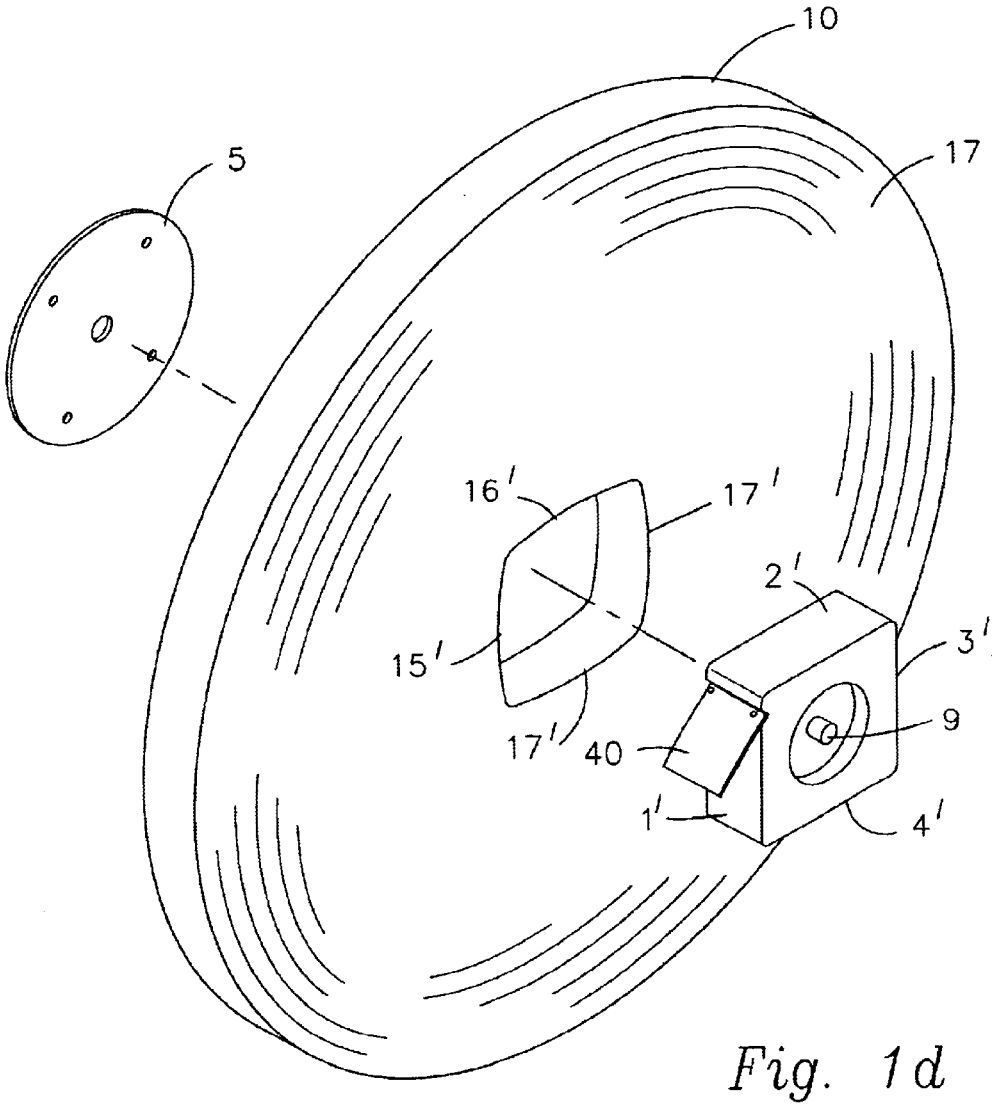
FIG. 1*d* shows an exploded perspective view of the spool for a roll dispenser according to the second embodiment of the present invention.
Figure 2A:
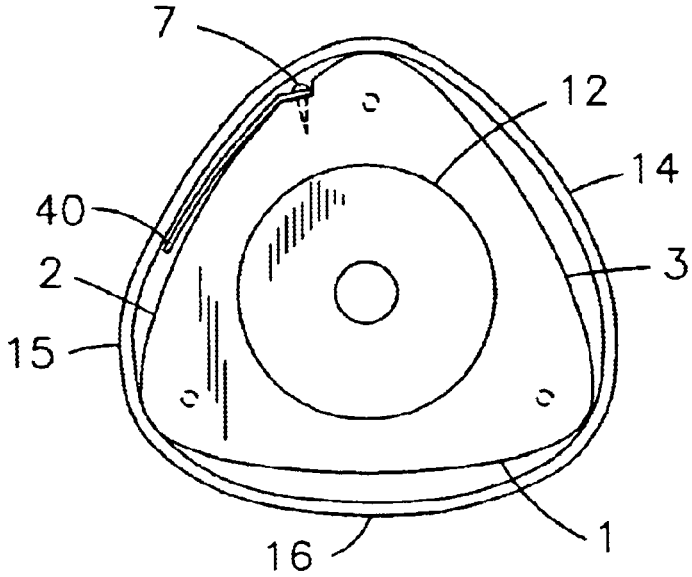
FIGS. 2 and 2*b* show a top view of the spool for a roll dispenser according to FIGS. 1*a* and 1*d* respectively.
Figure 2B:
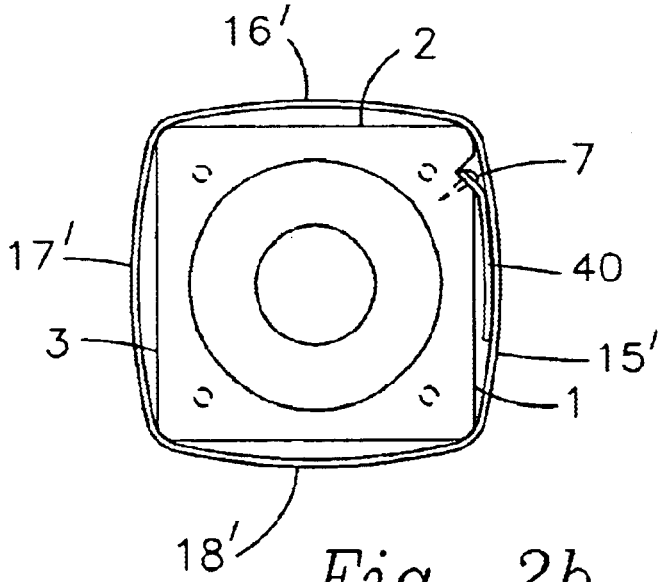
Figure 3A:
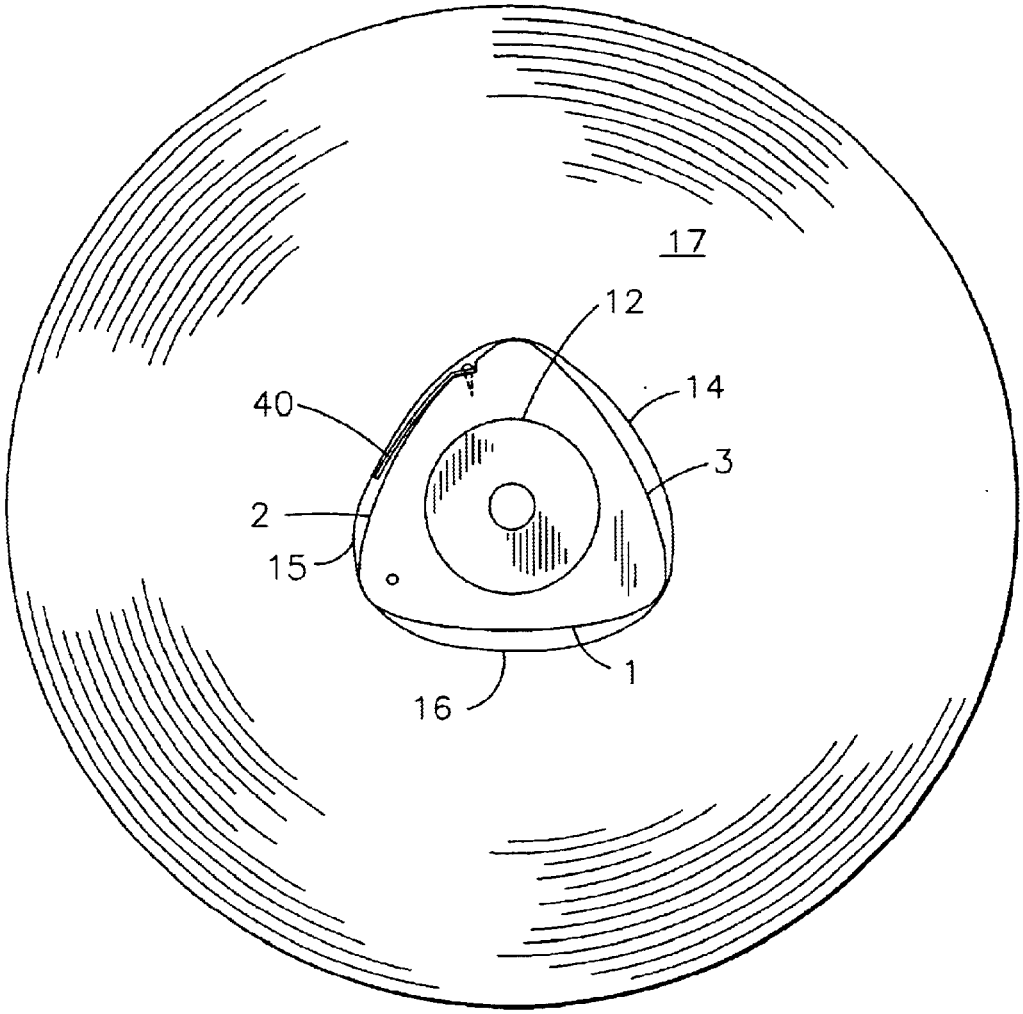
FIGS. 3 and 3*b* show a top view of the spool according to FIGS. 1 and 1*d* respectively in combination with the roll.
Figure 3B:
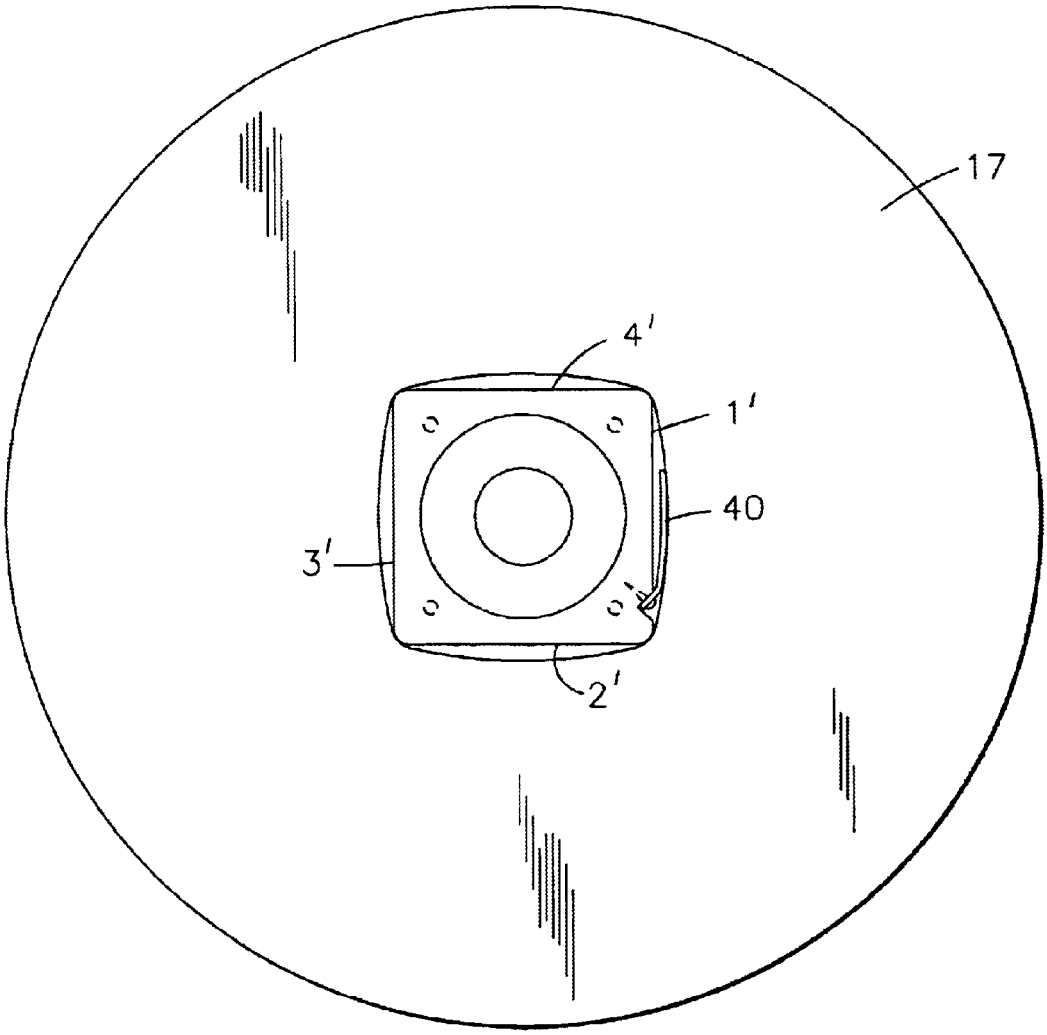
Figure 4A:
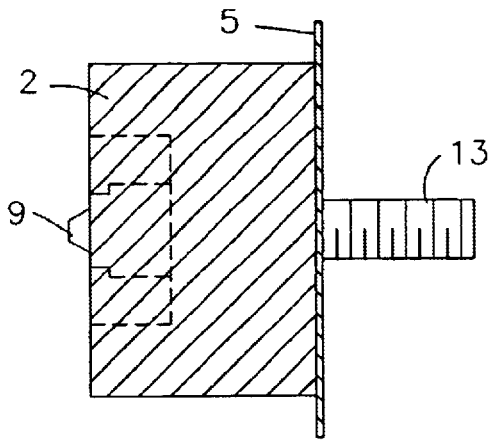
FIGS. 4 and 4*b* show an enlarged side view of the spool according to FIGS. 1*b* and 1*c* respectively.
Figure 4B:
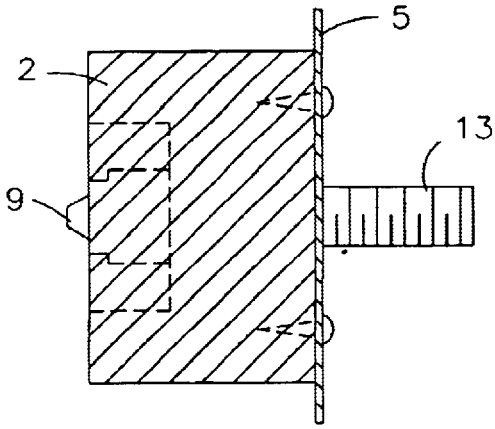
Figure 5A:
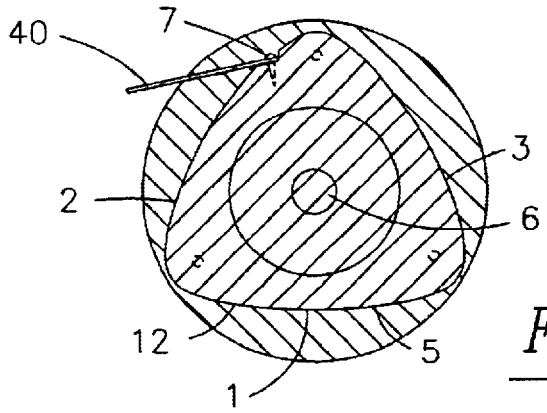
FIGS. 5 and 5*b* show a top view of the spool according to the first and second preferred embodiment according to the present invention
Figure 5B:
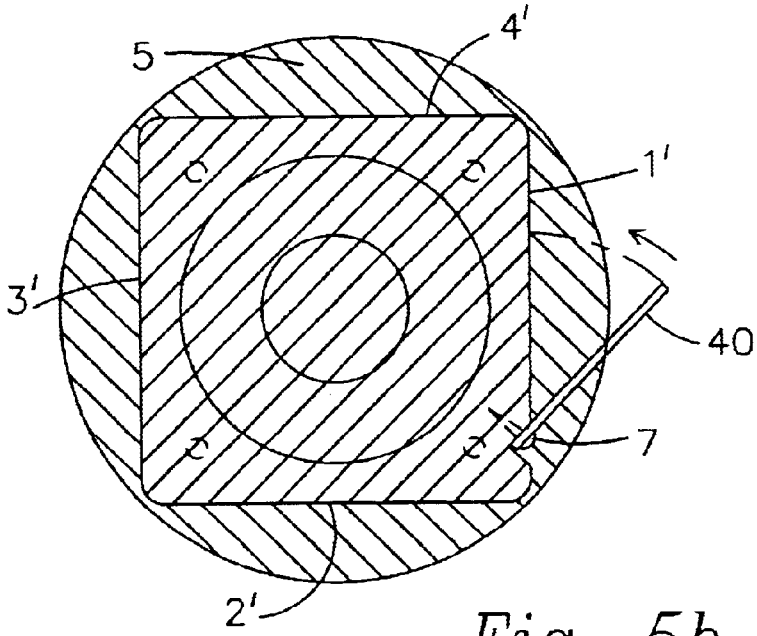
Figure 6:
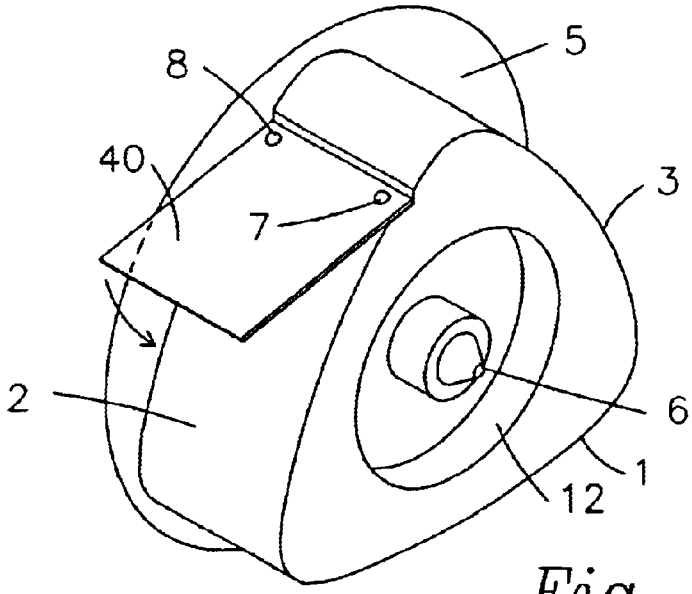
FIG. 6 shows a perspective view of the spool for a roll dispenser.

The operation and the mechanical understanding of the present invention will be analyzed next, referring to the descriptive figures, especially FIGS. 2, 4, and 5.

DETAILED DESCRIPTION OF THE INVENTION

A spool or hub 10 will be adapted to the roll dispenser in order to carry an adhesive tape.

The spool or hub 10 was designed with a section very similar to that of a triangle which will be called: "For Delta Rolls" and for a second preferred embodiment of the invention with a section very similar to that of a square which will be called "For Quadrilateral rolls".

The spool, while working with rolls with "delta-shaped" centers and for a second preferred embodiment of the invention "Quadrilateral-shaped" center—as you will see further on—will stop the sliding of the rolls on the spool; therefore, avoiding the problem with inconsistency in the tape tension.

The curvature of the faces of the triangular and for a second preferred embodiment of the invention square section of the spool, allows the installation of a bigger calibrated clutch, which results in a better control over the tension of the roll in the roll dispenser.

The curvature of the faces of the spool is smaller than the one of the centre of the rolls in order to allow a space that enables the installation of a spring in the shape of a sheet or the like. This sheet hinders the "axial" motion on the spool or hub.

The taped roll, which will be set in the spool or hub will have—in the same way as the spool or hub—a special shape similar to a triangle which will be called "Delta", and for a second preferred embodiment of the invention, a special shape similar to a square which will be called "Quadrilateral".

The structure has as the main feature; a bigger curvature in the sides facing the sides of the spool or hub, so that there is a certain space in between them, which furnishes a space or distance in order to fit a spring with the shape of a plate or sheet. This sheet will press an upward force from the spool toward one of the "Delta" walls of the roll and for a second preferred embodiment of the invention "Tetrahedral"; thus, avoiding the "axial" motion on the spool or hub.

Now, a complete description of the spool for a roll dispenser, relative to FIGS. 2, 2*b*, 4, 4*b*, 5, 5*b*.

The structure of the spool of a section which is similar to a triangle which has its three faces 1, 2 and 3 having a curvature, and for a second preferred embodiment of the invention, as a square having for faces 1', 2', 3', and 4' without curvature.

FIG. 2 shows a structure perpendicular to the hub in the form of a flat plate (spring) 40. A special feature of this spring is that it will contact the section which will hold the delta shape of the roll, in a curved angle. The flat plate 40 will be fastened to the hub of the spool with screws 7 and 8. The second preferred embodiment of the invention shows a structure outwards to the hub in the form of a spring 40, and the special feature of this spring is that it will contact the section which will hold the square shape of the roll, in a curved angle. Said structure 40 in the form of a spring will be fastened to the hub of the spool with screws 7 and 8.

Between the circular empty space 12 and the sides of the hub, there is a section which is thicker and which will allow the placement within the empty space 12 of a clutch system 6 or 9 for a second preferred embodiment of the invention.

The present invention also includes an axle 13 that will be screwed to the roll dispenser.

The system is completed with a round plate 5 which will be fastened to the central part of the spool by three burr screws, which in a second preferred embodiment of the invention will be shown with number 5, and which will be fastened to the central part of the spool by four burr screws.

Concerning the description of the roll 17, the this one has the characteristic of having a center with three sides 14, 15, and 16 in the "Delta" shape or four sides 14', 15', 16', and 17' in the "Quadrilateral" shape for a second preferred embodiment of the invention, having as a characteristic a bigger curvature in the sides facing the sides of the spool or hub device for rolls.

What is claimed is:

1. A spool for a roll dispenser comprising:

a hub having an axis;

an empty space between the hub and the roll; and a flat plate attached to one of the sides of the hub;

wherein the flat plate contacts the roll in a curved angle; and wherein the roll has a triangular core.

2. A spool for a roll dispenser comprising:

a hub having an axis;

an empty space between the hub and the roll; and a flat plate attached to one of the sides of the hub;

wherein the flat plate contacts the roll in a curved angle; and wherein the roll has a rectangular core.

* * * * *